United States Patent [19]

Asakura et al.

[11] Patent Number: 4,459,055

[45] Date of Patent: Jul. 10, 1984

[54] INK RIBBON WHICH MAKES ILLEGIBLE THE CONTENTS OF INFORMATION AS TRANSFERRED

[75] Inventors: Osamu Asakura, Tokyo; Mineo Nozaki, Kawasaki; Masasumi Nagashima, Yokosuka; Yoshio Uchikata, Yokohama, all of Japan

[73] Assignee: Canon Kabushiki Kaisha, Tokyo, Japan

[21] Appl. No.: 399,288

[22] Filed: Jul. 19, 1982

[30] Foreign Application Priority Data

Aug. 6, 1981 [JP] Japan ..... 56-122489

[51] Int. Cl.[3] ..... B41J 31/02

[52] U.S. Cl. ..... 400/237; 400/120; 400/241.1; 428/913; 428/914

[58] Field of Search ..... 400/83, 84, 85, 120, 400/227, 227.1, 240, 240.1, 240.3, 240.4, 241, 241.1, 241.2, 241.3, 241.4, 237, 697, 697.1, 713, 714; 428/914, 915, 916, 918, 919; 427/152, 256, 258; 283/91, 114; 350/163, 164; 355/7

[56] References Cited

U.S. PATENT DOCUMENTS

| | | | |
|---|---|---|---|
| Re. 27,180 | 9/1971 | Spreter et al. | 400/84 X |
| 1,305,296 | 6/1919 | Mackay | 428/919 X |
| 2,508,725 | 5/1950 | Newman | 400/241.1 X |
| 2,810,661 | 10/1957 | Newman et al. | 400/241.1 X |
| 3,625,334 | 12/1971 | Ahn | 400/227.1 X |
| 4,051,303 | 9/1977 | Hayashi et al. | 428/914 X |
| 4,303,307 | 12/1981 | Tureck et al. | 428/916 X |
| 4,321,309 | 3/1982 | Mino et al. | 428/914 X |

FOREIGN PATENT DOCUMENTS

| | | | |
|---|---|---|---|
| 55881 | 4/1980 | Japan | 400/120 |
| 55887 | 4/1980 | Japan | 400/120 |
| 6113 | 2/1982 | Japan | 428/916 |
| 89992 | 6/1982 | Japan | 400/120 |

OTHER PUBLICATIONS

IBM Technical Disclosure Bulletin, "Thermal Display Printer", Kitamura, vol. 16, No. 7, Dec. 1973, p. 2189.

IBM Technical Disclosure Bulletin, "Document Security", Munzel, p. 20.

*Primary Examiner*—Ernest T. Wright, Jr.

*Attorney, Agent, or Firm*—Fitzpatrick, Cella, Harper & Scinto

[57] ABSTRACT

An ink ribbon for a printing device comprises a substrate of a long thin web of a synthetic resin film having a solid ink coated on one surface thereof, the color of the substrate being the same as that of the solid ink. After the ink ribbon is used, the negative impressions left from the transfer of information to a printing sheet will be illegible.

5 Claims, 6 Drawing Figures

INK RIBBON WHICH MAKES ILLEGIBLE THE CONTENTS OF INFORMATION AS TRANSFERRED

BACKGROUND OF THE INVENTION

1. Field of the Invention

This invention relates to an ink ribbon. More particularly, it is concerned with an ink ribbon for use in a heat transfer printing device, a typewriter, and so forth, wherein the ribbon is made by applying a solid ink material on a web-formed base member, and is capable of transferring the ink on the base member to a printing sheet in desired patterns by applying pressure or heat to the ribbon.

2. Description of Prior Art

It has so far been a practice that this kind of ink ribbon has a pressure-fixing type solid oak coated on one surface side of the base member (or substrate) made of a synthetic resin film such as polyester, etc., in case it is used in an impact type printing device such as a typewriter, etc., and a heat-melting type solid ink coated on the substrate, in case it is used in a heat transfer printing device.

The ink ribbon is opposed to a printing sheet with its ink-coated surface facing the sheet and transfer of the ink on the ribbon is done by applying pressure or heat to the other surface of the ribbon i.e., the substrate side, in desired patterns.

The ribbon after use bears information as printed left on it in the form of negative images, because of the solid ink on the substrate having been transferred to the printing sheet as the print patterns. In this case, if the ink and the substrate to bear the ink on it are of different color, e.g., black for the ink and colorless transparency for the substrate, the contents of the printed information can be retrieved at a glance, which would possibly invite leakage of important and secret information outside, if the ink ribbon is improperly disposed of after its use.

SUMMARY OF THE INVENTION

It is an object of the present invention to provide an ink ribbon for various printing devices, which makes illegible the contents of the information as printed.

The preceding object and other objects as well as the detailed construction of the present invention will become more apparent and understandable from the following description thereof, when read in conjunction with the accompanying drawing.

DETAILED DESCRIPTION OF PREFERRED EMBODIMENTS

Figure 1:
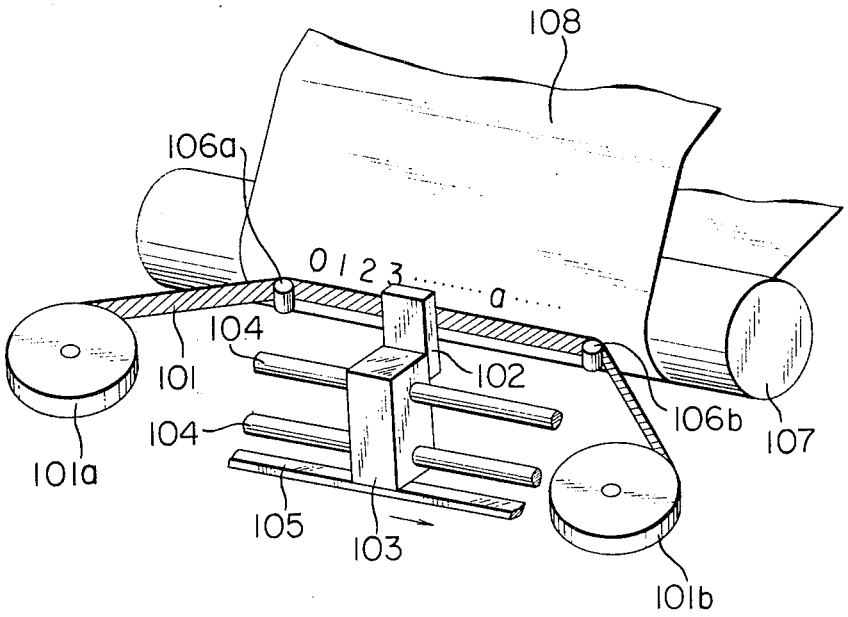
FIG. 1 PRIOR ART
FIG. 1 is a perspective view showing a general construction of a printing device, to which the ink ribbon according to the present invention is applied.

Referring first to FIG. 1 illustrating one embodiment of a printing machine using the ink ribbon according to the present invention, a reference numeral 101 designates the ink ribbon which is wound on an ink ribbon reel 101*a*, guided by guide pulleys 106*a* and 106*b* in a manner to be in close proximity to a printing sheet 108 held on and around a platen 107, and extended to an ink ribbon reel 101*b*, on which it is taken up after the printing operation.

The ink ribbon 101 has a heat-meltable or fusible solid ink consisting of a pigment such as carbon black, etc. or a dyestuff and a heat-meltable binder coated on one surface of its substrate of synthetic resin film such as polyester, etc., and is kept at such a position that its ink-coated surface may be readily contacted with the printing sheet 108.

For the web-shaped substrate constituting the ink ribbon 101, there may be used a thin metal sheet of stainless steel, copper, aluminum, and so forth, or a synthetic resin film of nylon, tetron, Teflon, acryl resin, polycarbonate, polyimide, phenol resin, and so forth. Of these various materials as listed above, those having heat-resistance and flexibility are preferable. The practical thickness of the substrate ranges from a few microns to a few millimeters.

The heat-meltable or fusible solid ink is composed of a coloring matter such as dye, pigment, etc.; a fusible substance such as a single body of waxy substance; and further a thermoplastic resin. For the waxy substance, there may be used beeswax, mineral oil, vegetable oil, and other oils and fats. Examples of these substances are: micro-crystalline wax, carnauba wax, hydrogenated castor oil wax, and other waxes; myristic acid, stearic acid, palmitic acid, behemic acid, and other higher fatty acids and their metal salts; monoglycerol stearate, paraffin, polyethylene glycol, urea, benzamide, acetoanilide benztriazole, phenacetine, dimedone bisphenol A, and so forth.

For the thermoplastic resin, there may be used polyvinyl chloride, polyvinylidene chloride, polyvinyl formal, polyvinyl butyral, polyvinyl alcohol, polyvinyl acetal, polycarbonate, polystyrene, cumarone resin, copolymer of vinyl chloride and acrylic acid ester, and others.

For the coloring matter, there may be used, besides dyestuffs and pigments, those components which form color in the substrate upon heating. Examples of the coloring matter are: multi-component heat-sensitive coloring agents such as combinations of long chain fatty acid iron salt (e.g. ferrous stearate, ferrous myristate) and phenols (e.g. tannic acid, gallate, ammonium salicylate), organic salts of precious metals (silver behemate, silver stearate) and aromatic organic reductive agents (protocatechuic acid, hydroquinone), lactones (crystal violet lactone, etc.) and phenols (bisphenol A, phenol resin), resorcin and nitroso compounds, tetrazolium salts and reductive agents and bases; pyrolytically reactive component type coloring matter such as combinations of amine generators (derivatives of urea, etc.) and pH reagents, amine generators and diazo compound and couplers, substituted benzene diazonium fluoroborate and polyhydric phenol and nitroso compounds, and amine generators and substances which bring about abrupt thermal decomposition when reaching a certain temperature level and cause a color forming reaction with the pyrolyzed product (graphite fluoride, etc.); independent coloring components such as indole derivatives pyrrolon derivatives, heavy metal salts of substituted amino-dithio-formic acids, and other substances which form color independently upon application of heat.

Any of the above-enumerated combinations of various components is mixed and kneaded under heat, and coated on the abovementioned substrate film to a desired thickness by an appropriate coating method, while the mixture is in a soft or molten condition. The ink composition to be obtained in the above-described manner is given a compositional ratio such that it may exhibit the thermoplasticity within a temperature range of from about 40° C. to 200° C., or preferably, from 40° C. to 160° C. so as to respond well to heat from a thermal head when it is used as the heating source.

Figure 2:
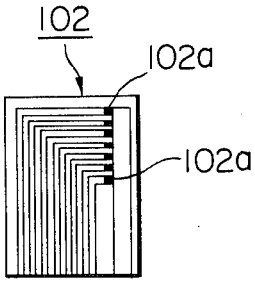
FIG. 2 PRIOR ART
FIG. 2 is a front view showing one embodiment of a thermal head, with which the ink ribbon according to the present invention is used.

As shown in FIG. 1, the thermal head 103 is disposed in opposition to the platen 107, and the ink ribbon 101 is passed through a clearance between the thermal head 102 and the platen 107 or the printing sheet 108 held on it. On the surface of this thermal head 102 facing the ink ribbon 101, there are provided heat generating resistive elements 102*a* in seven dots arranged in a vertical row as shown in FIG. 2. The thermal head 102 is supported on a carriage 103 which is in turn held slidably on guide rails 104 and is connected to element 105. It is moved by a pulse motor (not shown) in the direction of the arrow in FIG. 1 during the printing operation, and in the reverse direction during its return motion.

In synchronism with movement of the carriage 103, electric current is supplied to any desired element (or elements) in the heat generating resistive elements 102*a* to generate heat in the resistive element 102*a*. With the heat from the element 102*a*, the ink on the ink ribbon 101 is heated to melt pursuant to a pattern designated on the heat generating resistive elements 102*a*, whereby the image is transferred to the printing sheet 108.

Figure 3A:
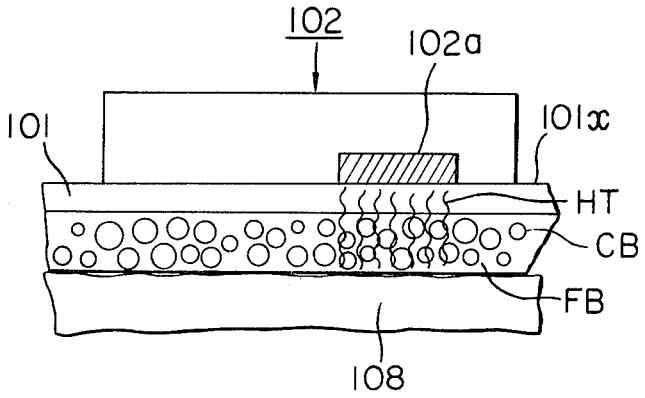
FIG. 3A PRIOR ART
FIGS. 3A and 3B are enlarged cross-sectional views of the thermal head and a part of the ink ribbon for explaining the construction of the conventional ink ribbon and printing method.
Figure 3B:
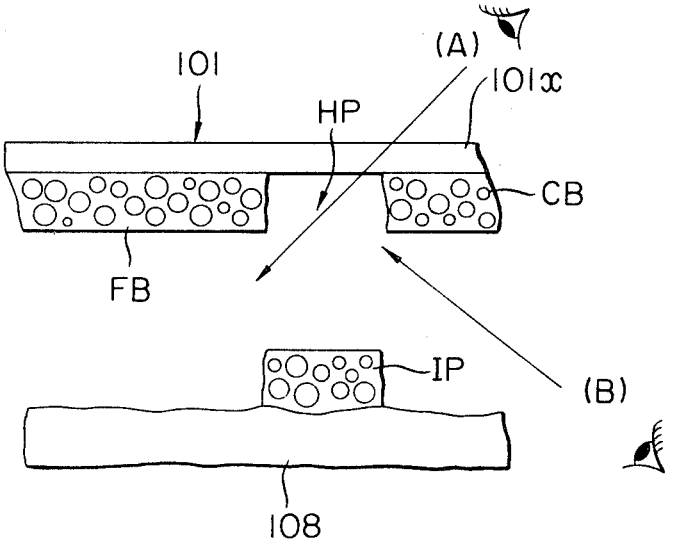
FIG. 3B PRIOR ART

FIGS. 3A and 3B illustrate enlarged cross-sectional views of the main part of the ink ribbon 101, in which a reference numeral 101*x* designates the substrate for the ink ribbon 101 made of polyester film, etc., on one surface of which carbon black CB as the black color element is coated using a fusible binder FB.

As soon as thermal head 102 generates heat upon electric current conduction to the heat generating resistive elements 102*a*, the heat HT is transmitted to the ink ribbon 101 as shown in FIG. 3A to thereby melt the fusible binder FB at a position opposite the resistive element 102*a* which has generated heat, and the ink of the heated portion HP is transferred to the printing sheet 108 as shown by the ink portion IP in FIG. 3B.

It is intended in this instance that the binder FB has a large affinity for the printing sheet 108, while it has a relatively small affinity for the substrate 101*x*.

At the time of printing, the ink ribbon 101 is urged against the printing sheet 108 under appropriate pressure, so that the fused ink can be readily transferred to the printing sheet 108. When the current conduction to the heat generating resistive elements 102*a* is stopped and the binder FB becomes solid again, the ink ribbon 101 is lifted off the printing sheet 108, and there remains on the printing sheet 108 an ink portion IP corresponding to the heated portion HP of the ink due to heat applied from the thermal head 102. In this manner, a desired pattern is formed by the ink portion IP transferred onto the printing sheet 108, and the printing operation is thus carried out.

After transfer of the ink onto the printing sheet 108, the heated portion HP on the ink ribbon 101, from which the ink has been removed, has the same pattern as the ink portion IP transferred to the printing sheet 108, as a matter of course, so that the contents of the printed information remain in the ink ribbon 101.

In this case, if the substrate 101*x* of the ink ribbon 101 is made of transparent polyester film, etc. as has been done generally, the printed pattern is seen as a negative image from whichever direction it may be observed, the rear surface (A) or the front surface (B) as in FIG. 3B. In particular, when the ink ribbon 101 is placed on a white sheet 108 as the background, the contents of the information as printed become legible without difficulty.

Figure 4:
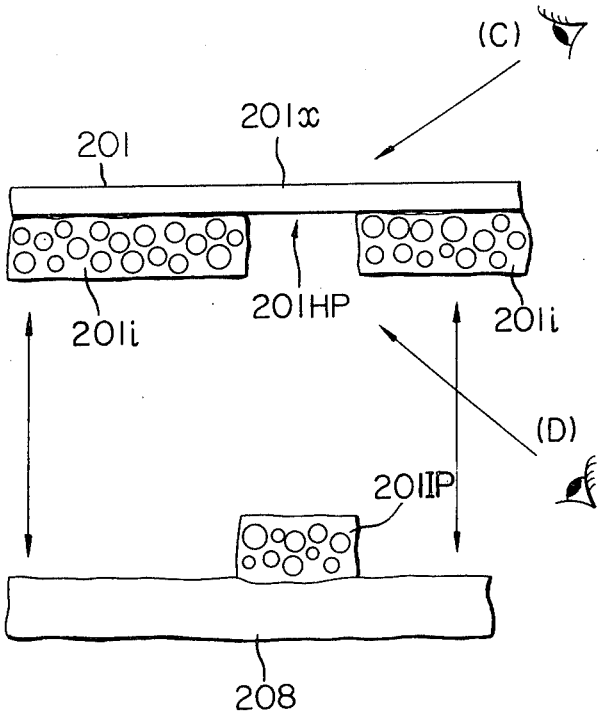
FIGS. 4 and 5 are enlarged cross-sectional views of the main part of the ink ribbons for explaining different embodiments of the present invention.

In case the substrate 101*x* for the ink ribbon 101 is of a thin metal sheet such as aluminum foil, etc., the mark of the print cannot be read from the direction of its rear surface (A) because the material making up the substrate 101*x* is non-transparent. However, the mark can be easily read as the negative image from the direction of its front surface (B) where the ink is coated. Therefore, in order to make the negative printed mark HP on the substrate 101*x* of the ink ribbon 101 illegible from either direction, the present invention uses a polyester film colored in the same color system as that of the heat-meltable ink 201*i* for the substrate 201*x* of the ink ribbon 201 as shown in FIG. 4, e.g., a black-colored, non-transparent polyester film. On account of this, the negative printed mark 201 HP cannot be seen even when the ink ribbon 201, after the transfer of the ink portion 201IP to the printing sheet 208, is viewed from the rear surface direction (C) thereof, since it is non-transparent. Further, when it is viewed from the front surface direction (D) thereof where the ink 201*i* is coated, the negative printed mark 201HP of the print pattern is seen to be present, but, since the substrate 201*x* in this negative mark portion is in black as is the ink 201*i*, the entire front surface appears black, whereby the contents of the printed information cannot be easily read. In this way, there can be obtained an ink ribbon 201 which makes it difficult to retrieve the contents of the printed information.

Figure 5:
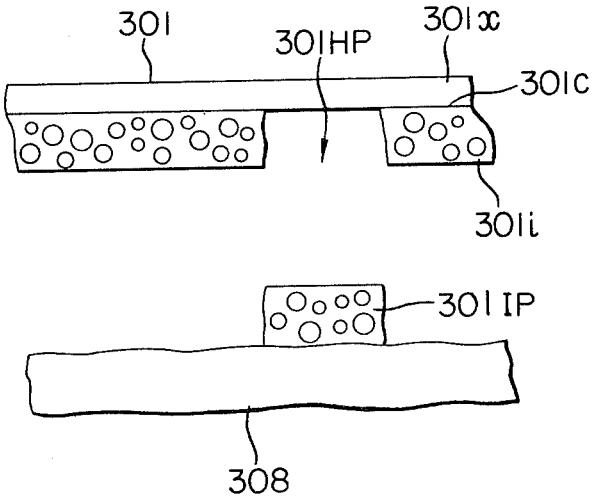

FIG. 5 shows another embodiment, in which a thin metal sheet such as aluminum foil, etc. is used for the substrate 301*x* of the ink ribbon 301. In this embodiment, a colored layer 301*c* is placed on one surface of the ink ribbon substrate 301*x*, preferably where the heat-meltable ink 301*i* is coated, so as to give the substrate 301*x* the same color as that of the ink 301*i*, e.g., black, and to make it impossible thereby to readily read the negative printed mark 301HP of the information left on the ink ribbon 301 after transfer of the ink portion 301IP to the printing sheet 308.

In the foregoing embodiments of the present invention, explanations have been given for the case of using the heat-meltable or fusible ink alone. It should, however, be noted that the invention can be applied, in exactly the same manner as mentioned above, to a pressure-fixing type ink ribbon, etc. used in an impact printer and so on. In passing, it should also be noted that the color of the ink is not limited to black, but any color may be used as desired.

As is apparent from the foregoing explanation, since the substrate of the ink ribbon according to the present invention is of the same color as that of the solid ink, the negative mark of the printed information left on the ink ribbon can be made illegible, whereby there can be obtained the ink ribbon which makes it difficult to retrieve the printed information therefrom.

What we claim is:

1. An ink ribbon, comprising:

a substrate in web-form made of a flexible film; and an ink coated on one surface of said substrate, said substrate being of the same color as that of said ink.

2. An ink ribbon as set forth in claim 1, wherein said substrate is made of a synthetic resin film.

3. An ink ribbon as set forth in claim 1, wherein said substrate is made of a thin metal sheet, one surface of which is colored in the same color as that of the ink.

4. An ink ribbon as set forth in claim 1, wherein said ink consists essentially of a coloring matter and a fusible substance.

5. An ink ribbon as set forth in claim 4, wherein said coloring matter contains a substance which forms color upon heating.

* * * * *

UNITED STATES PATENT AND TRADEMARK OFFICE

CERTIFICATE OF CORRECTION

PATENT NO. : 4,459,055

DATED : July 10, 1984

INVENTOR(S) : OSAMU ASAKURA, ET AL.

It is certified that error appears in the above-identified patent and that said Letters Patent is hereby corrected as shown below:

Column 1

Line 19, change "oak" to --ink--.

Column 2

Line 63, change "compound" to --compounds--.

Column 3

Lines 2-3, insert --,--, following "derivatives", first occurrence,

Line 18, change "103" to --102--.

Signed and Sealed this

*Eleventh* Day of *December 1984*

[SEAL]

*Attest:*

GERALD J. MOSSINGHOFF

*Attesting Officer*

*Commissioner of Patents and Trademarks*